US009630201B2

(12) United States Patent
Fabrey

(10) Patent No.: US 9,630,201 B2
(45) Date of Patent: Apr. 25, 2017

(54) POWER ARM FIRE HOSE ATTACHMENT

(71) Applicant: Joseph Robert Fabrey, Port Saint Lucie, FL (US)

(72) Inventor: Joseph Robert Fabrey, Port Saint Lucie, FL (US)

( * ) Notice: Subject to any disclaimer, the term of this patent is extended or adjusted under 35 U.S.C. 154(b) by 182 days.

(21) Appl. No.: 13/781,697

(22) Filed: Feb. 28, 2013

(65) Prior Publication Data

US 2014/0238706 A1 Aug. 28, 2014

(51) Int. Cl.

| | |
|---|---|
| ***A62C 33/04*** | (2006.01) |
| ***B05B 15/06*** | (2006.01) |
| ***A62C 31/28*** | (2006.01) |
| *B05B 9/01* | (2006.01) |
| *A62C 17/00* | (2006.01) |

(52) U.S. Cl.

CPC ..... *B05B 15/061* (2013.01); *A62C 31/28* (2013.01); *A62C 17/00* (2013.01); *A62C 33/04* (2013.01); *B05B 9/01* (2013.01)

(58) Field of Classification Search

CPC B05B 9/01; B05B 9/08; B05B 12/002; B05B 11/00; B05B 7/24; B05B 7/1209; B05B 7/02; B05B 15/061; A62C 31/28; A62C 31/02; A62C 31/03; A62C 33/00; A62C 33/06; A62C 33/04

See application file for complete search history.

(56) References Cited

U.S. PATENT DOCUMENTS

| | | | | |
|---|---|---|---|---|
| 4,216,911 | A * | 8/1980 | Huperz | B05B 9/01 239/526 |
| 5,199,642 | A * | 4/1993 | Rankin | B05B 1/1609 137/269 |
| 5,360,168 | A * | 11/1994 | McCue | A62C 33/00 239/525 |
| 9,364,868 | B2 * | 6/2016 | Bullard | B08B 3/028 |
| 2013/0303054 | A1 * | 11/2013 | Weigle, Jr. | F41H 9/04 451/40 |

* cited by examiner

*Primary Examiner* — Arthur O Hall
*Assistant Examiner* — Christopher R Dandridge

(57) ABSTRACT

A power arm is designed similar to a rifle stock that can be applied to a fire hose coupling via, for example, a quick detach rail system. The power arm can provide a firefighter with additional control of a fire hose which can be extremely helpful in a hostile environment. The power arm allows a firefighter to use their body as a whole to provide a maximum advantage for controlling a fire hose that is streaming water.

1 Claim, 2 Drawing Sheets

POWER ARM FIRE HOSE ATTACHMENT

BACKGROUND OF THE INVENTION

The present invention relates to firefighting equipment and, more particularly, to a rifle stock-like attachment detachably attached to a fire hose nozzle coupling for enhancing control of a fire hose.

Losing control of a high pressure hose, such as a fire hose, can have detrimental results, as such a loss of control can send the hose quickly, dangerously and randomly moving about.

Using a conventional firefighting hose nozzle can cause fatigue, injury and possibly death. If someone drops an active hose line flowing, for example, 200 gallons a minute full blast, people can get hurt. Moreover, advancing a hose line often requires several firefighters on each hose line, using valuable fire fighters in a single effort.

As can be seen, there is a need for an improved apparatus and method for controlling a fire hose.

SUMMARY OF THE INVENTION

In one aspect of the present invention, a nozzle device comprises a coupling operable to connect the nozzle device to a hose; at least one nozzle bracket disposed on the coupling; a power arm stock attachment removably attached to the coupling via the nozzle bracket, wherein the power arm stock attachment extends in a direction opposite a direction of water force from the nozzle device.

In another aspect of the present invention, a nozzle device for delivering water from a fire hose comprises a coupling operable to connect the nozzle device to a hose; at least one nozzle bracket disposed on the coupling; a power arm stock attachment removably attached to the coupling via the nozzle bracket; a rail bracket disposed on the power arm stock attachment, the rail bracket removably attached to the nozzle bracket, wherein the power arm stock attachment extends in a direction opposite a direction of water force from the nozzle device; and the power arm stock attachment extends from the nozzle device to contact a user when the user is operating the nozzle device to expel water therefrom.

In a further aspect of the present invention, a method for controlling a fire hose comprises removably attaching a power arm stock attachment to a nozzle bracket on a coupling of a nozzle device; supporting the power arm stock attachment against an arm-crevice region of the user while holding the nozzle device in front of a user; and opening a valve to expel water from the nozzle device, wherein nozzle force, directed toward the user opposite that of water force, is absorbed by a body of the user.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a power arm designed similar to a rifle stock that can be applied to a fire hose coupling via, for example, a quick detach rail system. The power arm can provide a firefighter with additional control of a fire hose which can be extremely helpful in a hostile environment. The power arm allows a firefighter to use their body as a whole to provide a maximum advantage for controlling a fire hose that is streaming water.

Figure 1:
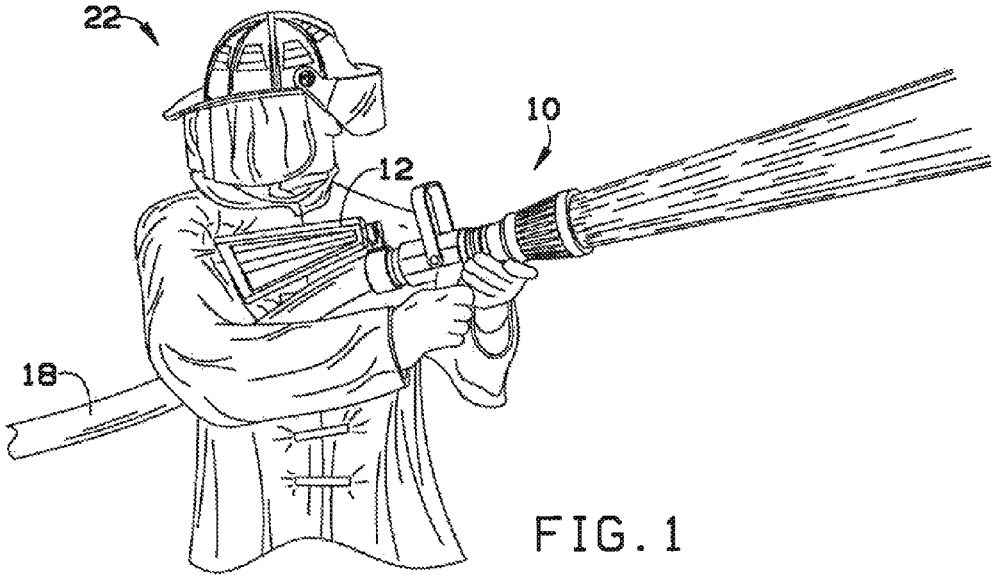
FIG. 1 is a perspective view of a fire hose attachment, in use, according to an exemplary embodiment of the present invention.
Figure 2:
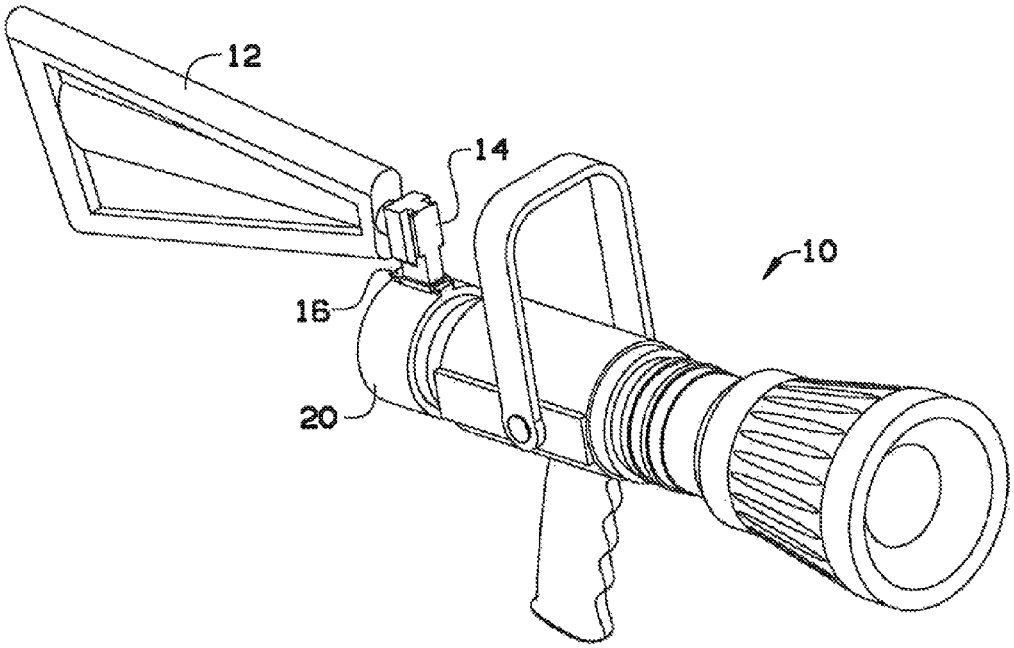
FIG. 2 is a perspective of the fire hose attachment, attached to a nozzle.
Figure 3:
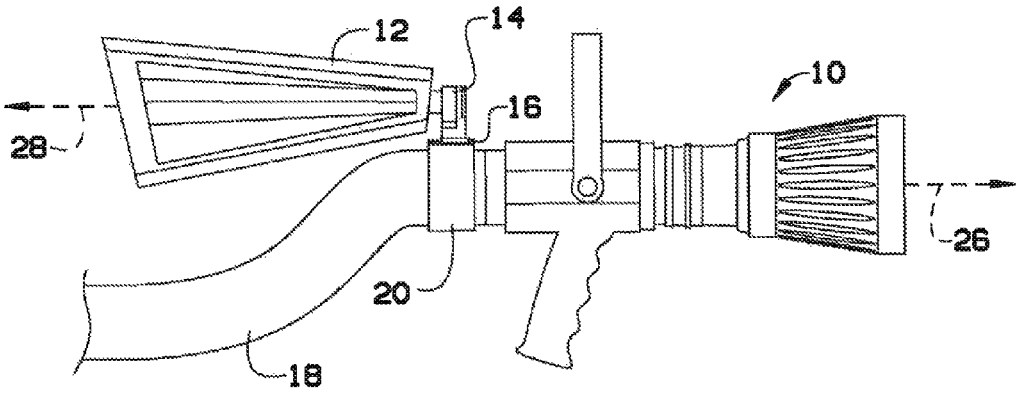
FIG. 3 is a side view of the fire hose attachment and nozzle of FIG. 2.
Figure 4:
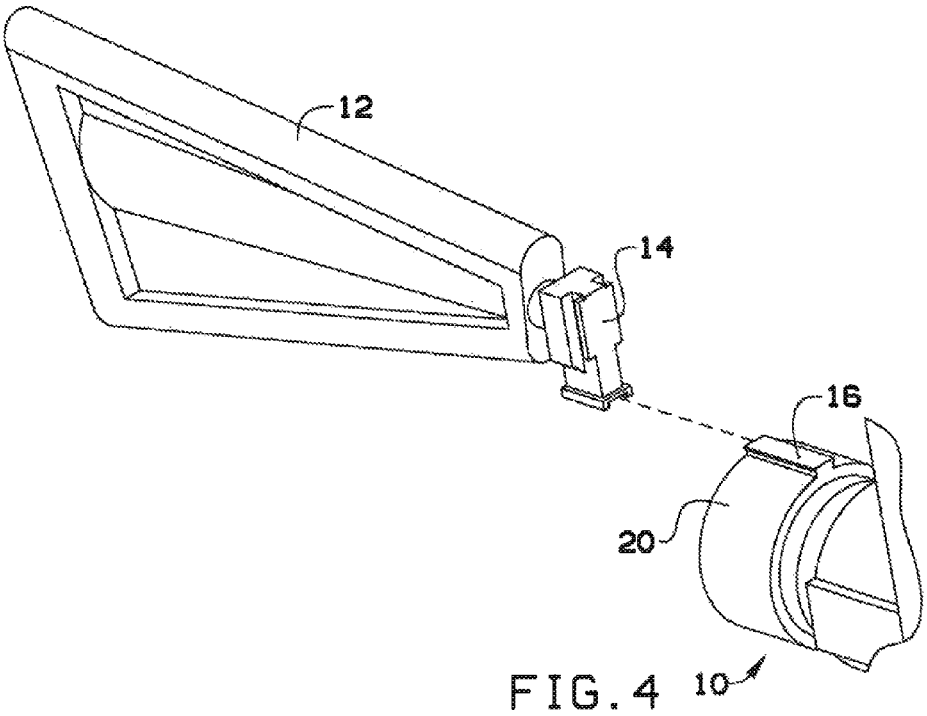
FIG. 4 is an exploded perspective view of the fire hose attachment removed from a coupling member.

Referring to FIGS. 1 through 4, a nozzle device 10 can include a nozzle bracket 16 disposed on a hose coupling 20. The hose coupling 20 can connect the nozzle device 10 to a fire hose 18.

The nozzle bracket 16 can receive a rail bracket 14 attached to a power arm stock attachment 12. The power arm stock attachment 12 can be shaped similar to a rifle stock, for example. The stock attachment 12 can removably attach to the hose coupling 16 via a mating connection between the rail bracket 14 and the nozzle bracket 16. In some embodiments, the rail bracket 14 and the nozzle bracket 16 can form a dovetail connection, allowing the rail bracket 14 to be slid on the nozzle bracket 16 in a single direction, for example.

Various removable attachments are contemplated within the scope of the present invention. In some embodiments, the power arm stock attachment 12 can slide onto the nozzle bracket 16 in a direction of water force 26 so that when nozzle force 28 drives the power arm stock attachment 12 toward an arm-crevice region of a firefighter 22, the power arm stock attachment 12 is retained on the nozzle bracket 16. In some embodiments, the power arm stock attachment 12 can be frictionally retained on the nozzle bracket 16 where a force applied to the power arm stock attachment 12 in the nozzle force 28 direction can be used to remove the power arm stock attachment 12 from the nozzle bracket 16.

The nozzle bracket 16 can be formed integrally with the fire hose coupling 20. Various size couplings 20 can be used for various size fire hoses 18. In some embodiments, the coupling 20 can be formed into the nozzle device 10 and in other embodiments, the coupling 20 can be a member separable from the nozzle device 10.

While the Figures show a single nozzle bracket 16 on the coupling 20, in some embodiments, multiple nozzle brackets 16 can be disposed on the coupling 20, allowing the power arm stock attachment 12 to attach at various locations around the coupling 20.

The power arm stock attachment 12 allows the firefighter to use their body as a whole, thus reducing fatigue, stress and the risk of losing control. The nozzle device 10 of the present invention, with the power arm stock attachment 12, allows the firefighter to focus on fighting the fire rather than focusing on oneself and controlling the hose.

The nozzle device 10 of the present invention can be used for various hose lines in various applications, including firefighting applications as well as other applications where a stream of water exits a human controlled nozzle. For example, the nozzle device 10 can be used by airport fire departments, naval ship firefighters, municipal fire departments, professional and volunteer firefighters and the like.

It should be understood, of course, that the foregoing relates to exemplary embodiments of the invention and that modifications may be made without departing from the spirit and scope of the invention as set forth in the following claims.

What is claimed is:

1. A support device for a nozzle comprising:

A nozzle device

A fire hose

And a power arm stock attachment

The nozzle device, fire hose and power arm stock attachment forming an assembly

The nozzle device comprising

A pistol grip

A lever

Said lever actuating a valve

A nozzle inlet, defining a rear of the nozzle device

A nozzle outlet, defining a front of the nozzle device

And a cylindrical coupling matingly received on an external surface of the nozzle outlet Wherein the nozzle inlet and cylindrical coupling are arranged concentrically about a central lateral axis of the nozzle device, said central axis extending from the nozzle inlet to the nozzle outlet, perpendicularly to the lever The cylindrical coupling comprising An internal surface that matingly receives the fire hose, while the cylindrical coupling is coupled to the external surface of the nozzle inlet And an external surface that includes a dovetail shaped nozzle bracket projecting therefrom Said nozzle bracket extending from the rear to front of the cylindrical coupling Wherein the cylindrical coupling receives the power arm stock attachment on the nozzle bracket The power arm stock attachment comprising a rifle stock support formed integrally with a rail bracket The rail bracket comprising a socket shaped to complimentarily mate with the nozzle bracket by a dovetail connection Such that the power arm stock attachment is mounted to the nozzle bracket by sliding the power arm stock attachment along the external surface of the rail bracket in a direction from the rear of the nozzle device toward the front of the nozzle device Wherein In use, water flows through the fire hose into the nozzle device, through the valve and is expelled laterally from the nozzle outlet Such that a water force is created by the water opposite the direction of water expulsion Said water force driving the power arm stock attachment to a torso of a user and the power arm stock attachment is frictionally retained on the nozzle bracket.

* * * * *